US008360430B2

(12) United States Patent
Kammerl

(10) Patent No.: US 8,360,430 B2
(45) Date of Patent: Jan. 29, 2013

(54) TABLE BALL GAME DEVICE

(76) Inventor: Gerhard Kammerl, Deggendorf (DE)

( * ) Notice: Subject to any disclaimer, the term of this patent is extended or adjusted under 35 U.S.C. 154(b) by 247 days.

(21) Appl. No.: 12/663,953

(22) PCT Filed: Feb. 13, 2008

(86) PCT No.: PCT/DE2008/000255

§ 371 (c)(1),
(2), (4) Date: Dec. 10, 2009

(87) PCT Pub. No.: WO2009/100693

PCT Pub. Date: Aug. 20, 2009

(65) Prior Publication Data

US 2010/0301552 A1 Dec. 2, 2010

(51) Int. Cl.

| | |
|---|---|
| ***A63F 7/00*** | (2006.01) |
| ***A63F 7/26*** | (2006.01) |
| ***A63F 7/36*** | (2006.01) |

(52) U.S. Cl. ..... 273/119 A; 273/118 R; 273/118 A; 273/119 R; 273/121 D; 273/129 R; 273/129 S; 273/129 T; 273/129 V; 273/129 W

(58) Field of Classification Search ..... 273/118 R, 273/118 A, 119 R, 119 A, 121 A, 121 D, 273/122 R, 122 A, 129 R, 129 S, 129 T, 129 V, 273/129 W See application file for complete search history.

(56) References Cited

U.S. PATENT DOCUMENTS

| | | | | |
|---|---|---|---|---|
| 2,842,398 A | | 7/1958 | Conner | |
| 3,582,074 A | * | 6/1971 | Menotti | 273/121 A |
| 3,656,753 A | * | 4/1972 | Juneau | 273/122 R |
| 3,675,927 A | * | 7/1972 | Gottlieb et al. | 273/119 A |
| 3,787,052 A | * | 1/1974 | Glass et al. | 273/357 |
| 3,866,917 A | | 2/1975 | Ensmann et al. | |
| 3,975,019 A | * | 8/1976 | Barlow | 273/121 A |
| 4,185,824 A | * | 1/1980 | Natwick | 273/356 |
| 4,807,886 A | * | 2/1989 | Van Elderen et al. | 273/356 |
| 5,368,300 A | * | 11/1994 | Becker | 273/121 R |
| 5,961,116 A | * | 10/1999 | Beyer | 273/119 R |
| RE37,451 E | * | 11/2001 | Guridi | 273/119 R |
| 6,554,278 B1 | * | 4/2003 | Haddox | 273/119 R |
| 2005/0073092 A1 | * | 4/2005 | Oister et al. | 273/119 R |
| 2010/0301552 A1 | * | 12/2010 | Kammerl | 273/119 R |

FOREIGN PATENT DOCUMENTS

| | | |
|---|---|---|
| DE | 2151191 A1 | 4/1973 |
| EP | 0306557 A | 3/1989 |
| GB | 215709 A | 7/1958 |
| JP | 2003159389 A | 6/2003 |
| RU | 2185585 C2 | 7/2002 |
| WO | 9805394 A | 2/1998 |

OTHER PUBLICATIONS

"PCT International Search Report dated Oct. 16, 2008 for PCT/DE2008/000255, from which the instant application is based," 4 pgs.

* cited by examiner

*Primary Examiner* — Raleigh W. Chiu
(74) *Attorney, Agent, or Firm* — Fredrikson & Byron, P.A.

(57) ABSTRACT

The present invention relates to a table ball game device (1), comprising a game field (2) and a game table comprising a game field edge (3), wherein on at least one narrow side (4) at least one launch apparatus (5) for launching spheres (6) at a ball (7) are pivotally disposed, wherein the at least one launch apparatus (5) is associated with a feed apparatus (8) for automatically feeding the spheres to the at least one launch apparatus (5).

16 Claims, 12 Drawing Sheets

FIG 2 II-II

FIG 3 III-III

FIG13 VII-VII

TABLE BALL GAME DEVICE

RELATED APPLICATIONS

This application claims priority to International Application No. PCT/DE2008/000255, filed Feb. 13, 2008, the teachings of which are incorporated herein by reference.

The present invention relates to a table ball game device with a playing table comprising a playing field and a playing field edge, wherein at least one launching device for launching balls at a playing ball is arranged pivotably on at least one narrow side.

In the case of known devices of this type, the shot balls have to be picked up, for example, by hand and entered into a ball launching track or into a ball magazine provided in the housing of a launching device. This operation is relatively complicated and precludes a rapid flow of play.

In a further embodiment of a table ball game device from the prior art (DE 2 151 191), the balls are supplied to the launching track of a launching device by means of a magnetic lever which has to be actuated and which brings the balls into the launching track of the launching device. If a ball is not located in the vicinity of the magnetic lever, the device has to be displaced along the playing field edge as far as a point at which balls are located. As an alternative, balls located on the playing field have to be pushed onto the device by hand. This manner of supplying the balls is also relatively complicated and clearly precludes a smooth flow of play.

The present invention is based on the object of providing a table ball game device which overcomes the disadvantages of the prior art.

This object is achieved according to the invention by a table ball game device with a playing table comprising a playing field and a playing field edge, wherein at least one launching device for launching balls at a playing ball is arranged pivotably on at least one narrow side, and wherein the at least one launching device is assigned a supply device for automatically supplying the balls to the launching device.

By means of the supply device which permits fully automatic supplying of the balls to the launching device, a virtually uninterrupted flow of play is made possible without balls having to be supplied to the launching device manually or by carrying out mechanical work (for example actuating a lever). The balls to be launched are automatically supplied continuously to the launching device by the automatic supply by means of the supply device.

In a particularly preferred embodiment of the table ball game device according to the invention, the supply device comprises a preferably continuously rotating, in particular motor-operated pickup wheel for picking up and transporting the balls, and a ball magazine, preferably in the form of an elongate tube, which interacts with a pickup wheel, the pickup wheel feeding the balls into the ball magazine from where the balls, in turn, are fed successively into the launching device.

By means of the continuously rotating, preferably motor-operated pickup wheel which feeds the balls into the ball magazine, fully automatic loading of the ball magazine is possible without manual assistance. The presence of a ball magazine enables a plurality of balls to be mounted at the same time one behind another and to be fed successively into the launching device. By this means, relatively large gaps during the launching of the individual balls do not arise, since launched balls are immediately replaced by new balls already waiting in the ball magazine.

In a preferred embodiment of the table ball game device according to the invention, the pickup wheel has permanent magnets, preferably double-pole permanent magnets, for picking up and transporting the preferably magnetizable balls. This permits a particularly advantageous picking up and transporting of the balls (in particular metal balls). By means of the preferably double polarity of the permanent magnets, magnetic charging of the balls is prevented, this in turn preventing individual balls from sticking together.

In an embodiment of the table ball game device according to the invention which is suitable for playing by an individual player, a launching device is provided only on one narrow side while an automatically acting device (ball shooting device) for automatically shooting back the ball is arranged on the opposite narrow side, the direction of the shot-back ball preferable changing and being random. The direction of the ball can be determined, for example, by a random shot generator.

In another embodiment of the table ball game device according to the invention, a launching device is arranged on both narrow sides. This embodiment is suitable in particular for two players playing against each other.

In a particularly preferred embodiment of the table ball game device according to the invention for two players, the respective ball magazine can only receive a limited number of balls, and excess balls which can no longer be received by the ball magazine are removed by the pickup wheel and conducted, preferably via a transport passage, to a supply channel which is downwardly inclined toward the respectively opposite narrow side and by means of which said balls are transported to the respectively opposite supply device.

This ensures a continuous equalization of the balls between the two launching devices. It therefore prevents one player from "running out" of the balls while all of the balls are located on the other player's side. A smooth flow of play is thus ensured Vertical delimitations, preferably slots, are preferably provided in each case in the regions in front of the two launching devices, said vertical delimitations preferably extending from one longitudinal side of the table ball game device to the other longitudinal side of the table ball game device and through which only balls but not the playing ball can pass. The playing ball thereby always remains on the actual playing field whereas the launched balls can penetrate into a rear region where they can in turn be collected and picked up by the respective supply device and conducted to the launching device.

Goals into which the playing ball is intended to be driven with the aid of the balls are advantageously arranged in the region in front of the launching devices, the goals preferably being formed by the vertical delimitations. In a certain embodiment of the table ball game device according to the invention, the goals are formed form rectangular indentations in the vertical delimitations. This enables goals to be shot, but without the playing ball disappearing under or behind the vertical delimitation.

Light barriers for recording scored goals are generally provided, the scored goals preferably being displayable electronically. This arrangement considerably facilitates the counting of the scored goals.

The playing field is preferably slightly inclined downward from the center to the two narrow sides. This prevents a ball or the playing ball from remaining at a standstill on the playing field. All of the balls and also the playing ball always roll toward one of the two opposite launching devices.

In a preferred embodiment of the table ball game device according to the invention, the launching device is operated with the aid of a solenoid. This device has proven particularly effective for the table ball game device according to the invention, since particularly high launching frequencies can be obtained by this means.

The launching device advantageously has a laser. The laser beam emitted by the laser can be particularly readily aimed at the playing ball by the laser beam striking against the playing ball where it can be seen.

The launching device preferably has a pistol-shaped design with a handle in which a trigger for triggering the shooting mechanism is integrated, a solenoid preferably being activated when the shooting mechanism is triggered, said solenoid preferably setting a level into motion, said lever, in turn, setting a shooting pin into motion, the shooting pin, in turn, setting a ball which is to be launched into motion.

When the shooting mechanism is triggered, the lever is advantageously moved counter to the force of a spring by means of which the lever is returned again into its original position after the shot is triggered.

Further features of the invention emerge from the description below of preferred embodiments of the invention in conjunction with the drawings and the dependent claims. The individual features can each be implemented on their own or in combination with one another.

Figure 12:
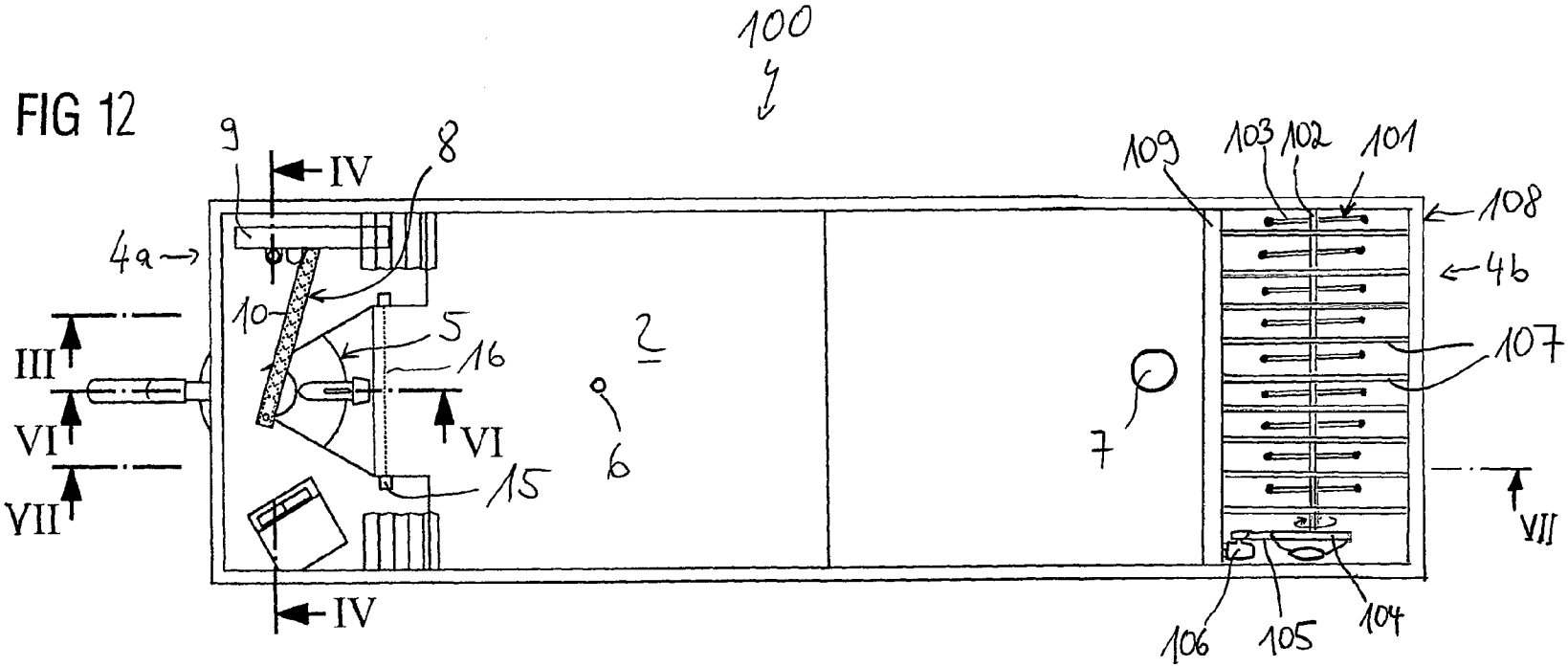
FIG. 12 shows a top view of a table ball game device according to the invention for one player.
Figure 13:
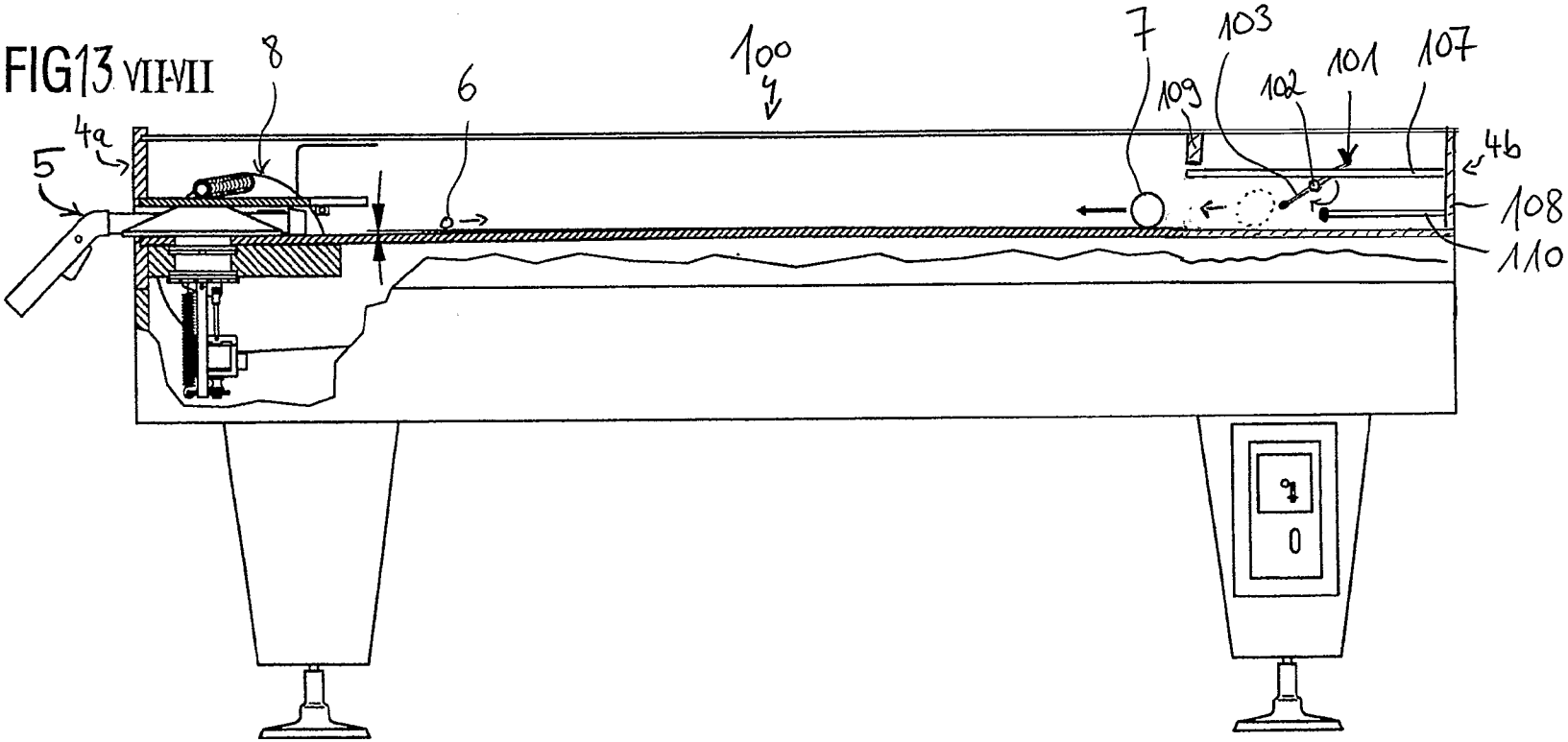
FIG. 13 shows a side view (partially longitudinally sectioned, VII-VII) of the table ball game device from FIG. 12.
Figure 14:
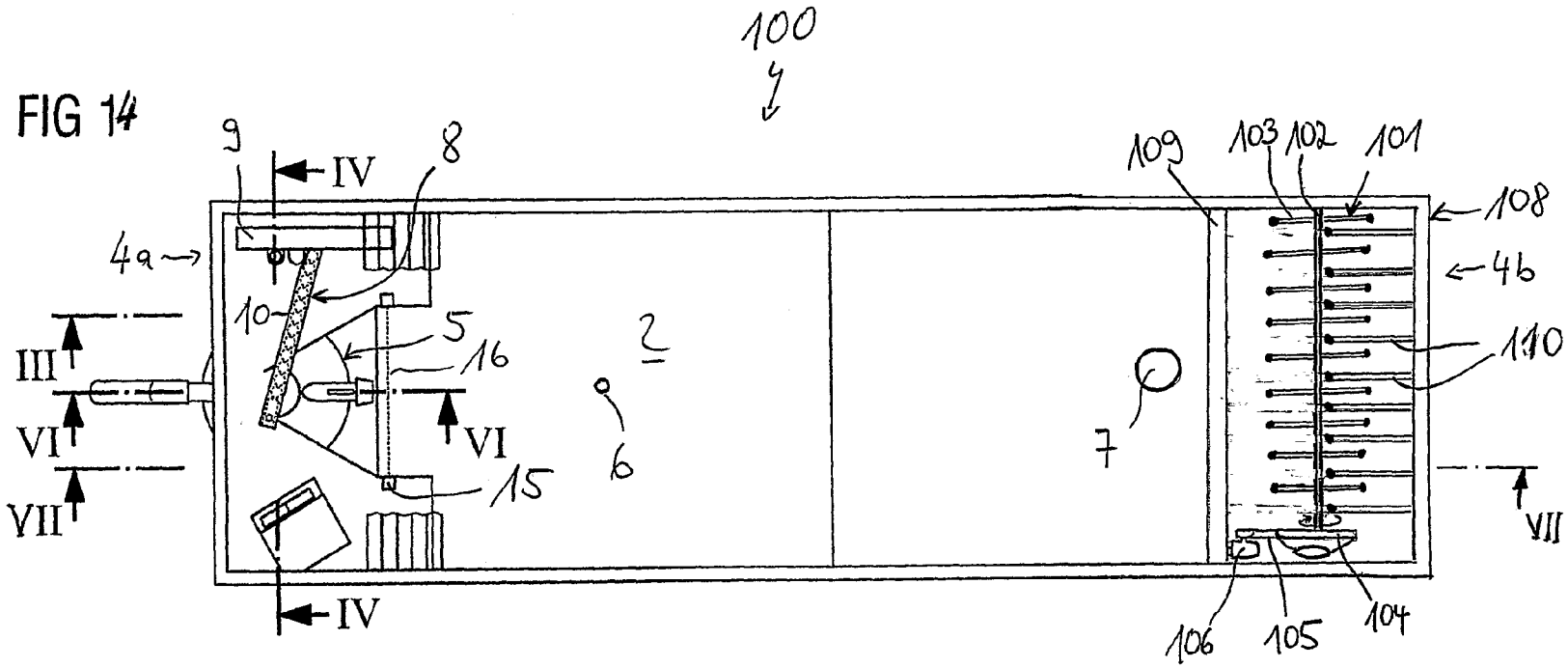

FIG. 14 shows the table ball game device 100 from FIGS. 12 and 13 with the cushioning bars 107 having been removed.

Figure 1:
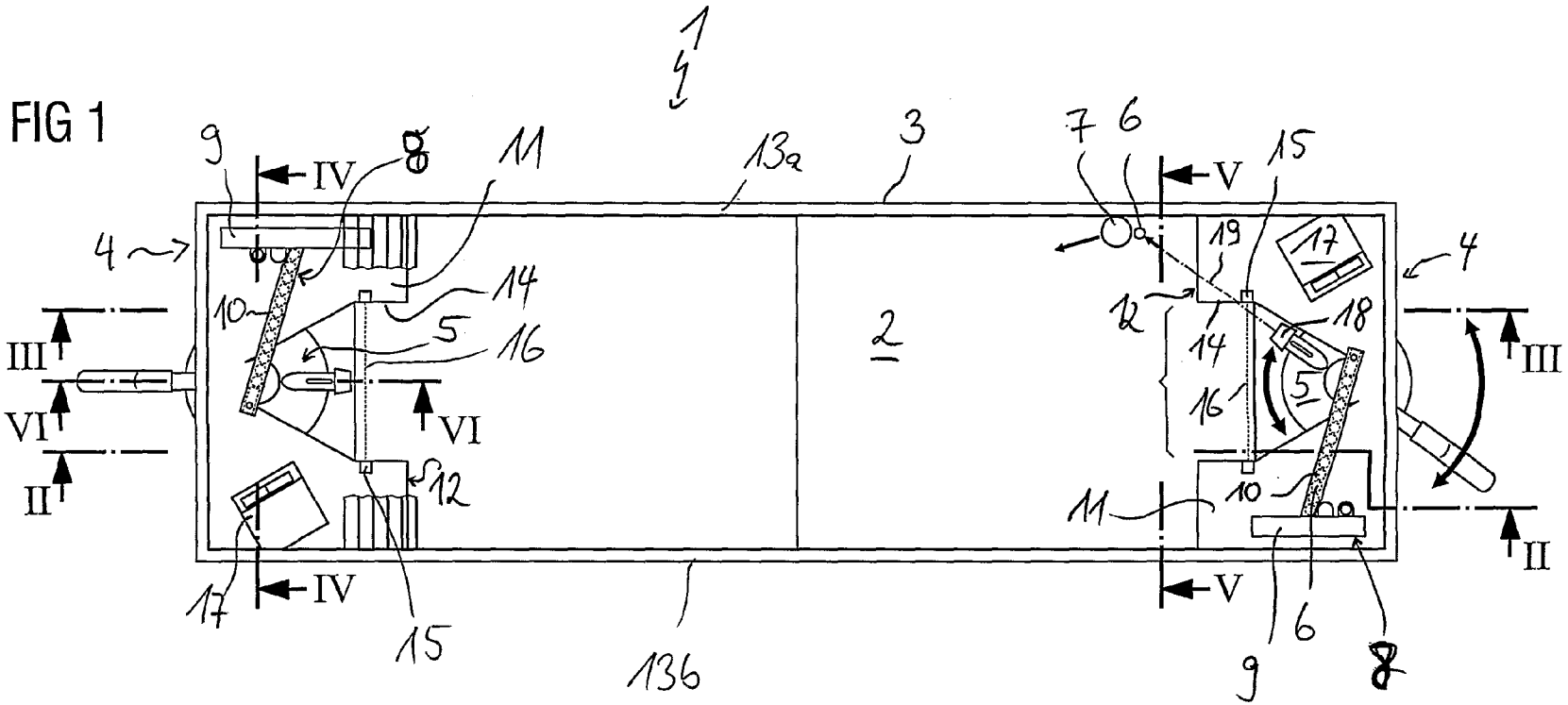
FIG. 1 shows a top view of a table ball game device according to the invention.

FIG. 1 shows a table ball game device 1 according to the invention with a playing field 2 and a playing field edge 3, on the opposite narrow sides 4 of which respective launching devices 5 for launching balls 6 at a playing ball 7 are pivotably arranged, wherein each of the two launching devices 5 is assigned a supply device 8 for automatically supplying the balls 6 to the respective launching devices 5. The launching devices 5 are coordinated with the playing field 2 in such a manner that there is no dead angle on the playing field, i.e. the playing ball 7 can be fired at by the balls 6 even in the corners of the playing field 2. The launching devices 5 may be attached directly to the narrow sides 4. However, in the present exemplary embodiment, they are not arranged directly on the narrow sides 4 but rather in the region of the narrow sides 4 (the expression in claim 1 "on the opposite narrow sides thereof" also includes embodiments in which the launching devices are arranged in the region of the narrow sides, as shown in FIG. 1).

The supply devices 8 each comprise a continuously rotating, motor-operated pickup wheel 9 (the motor is not visible here) and a ball magazine 10 in the form of an elongate tube interacting with the pickup wheel. The pickup wheel 9 feeds the balls 6 into the ball magazine 10 which, in turn, feeds the balls 6 successively into the launching device 5 (see detailed descriptions for FIGS. 8 and 9). Vertical delimitations in the form of plastic plates 11 are arranged in each case in the regions of the two launching devices 5. The plastic plates 11 give rise to slots 12 through which the balls 6, but not the playing ball 7, can pass. The slots 12 extend from one longitudinal side 13*a* to the other longitudinal side 13*b* of the table ball game device 1. Indentations 14 are made in the plastic plates 11, said indentations representing the goals of the game device. A respective light barrier 15 which emits a laser beam 16 is arranged in the region of the indentations 14. If the light barrier, which is arranged at such a height that it can be interrupted by the playing ball 7, but not by the balls 6, is interrupted, a scored goal is electronically displayed by the display 17 which, in turn, is in electric contact with the light barrier 15.

A laser 18 for aiming at the balls 16 is arranged on the launching devices 5. The arrow illustrated by dashed lines in the drawing is intended to illustrate the emitted laser beam 19.

Figure 2:
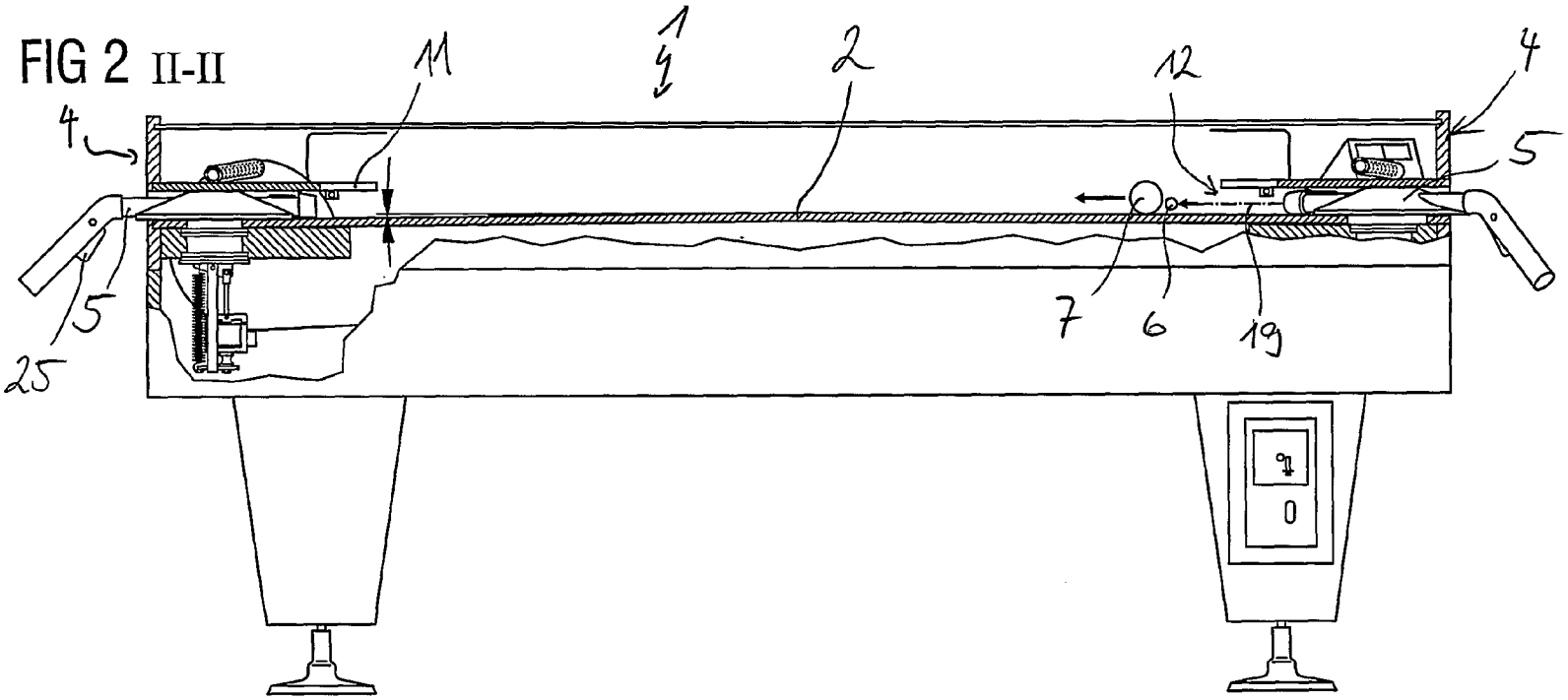
FIG. 2 shows a side view (partially longitudinally sectioned, II-II) of the table ball game device from FIG. 1.

FIG. 2 shows the table ball game device 1 from FIG. 1 sectioned along the line II-II. The launching devices 5 which are described in detail in conjunction with FIGS. 6 and 7 can readily be seen. It can also readily be seen in this figure that the playing field 2 is slightly downwardly inclined from the center toward the two narrow sides 4. As a result, the balls 6 or playing ball 7 cannot remain stationary at a location in the region of the playing field but rather always roll towards one of the two launching devices.

Figure 3:
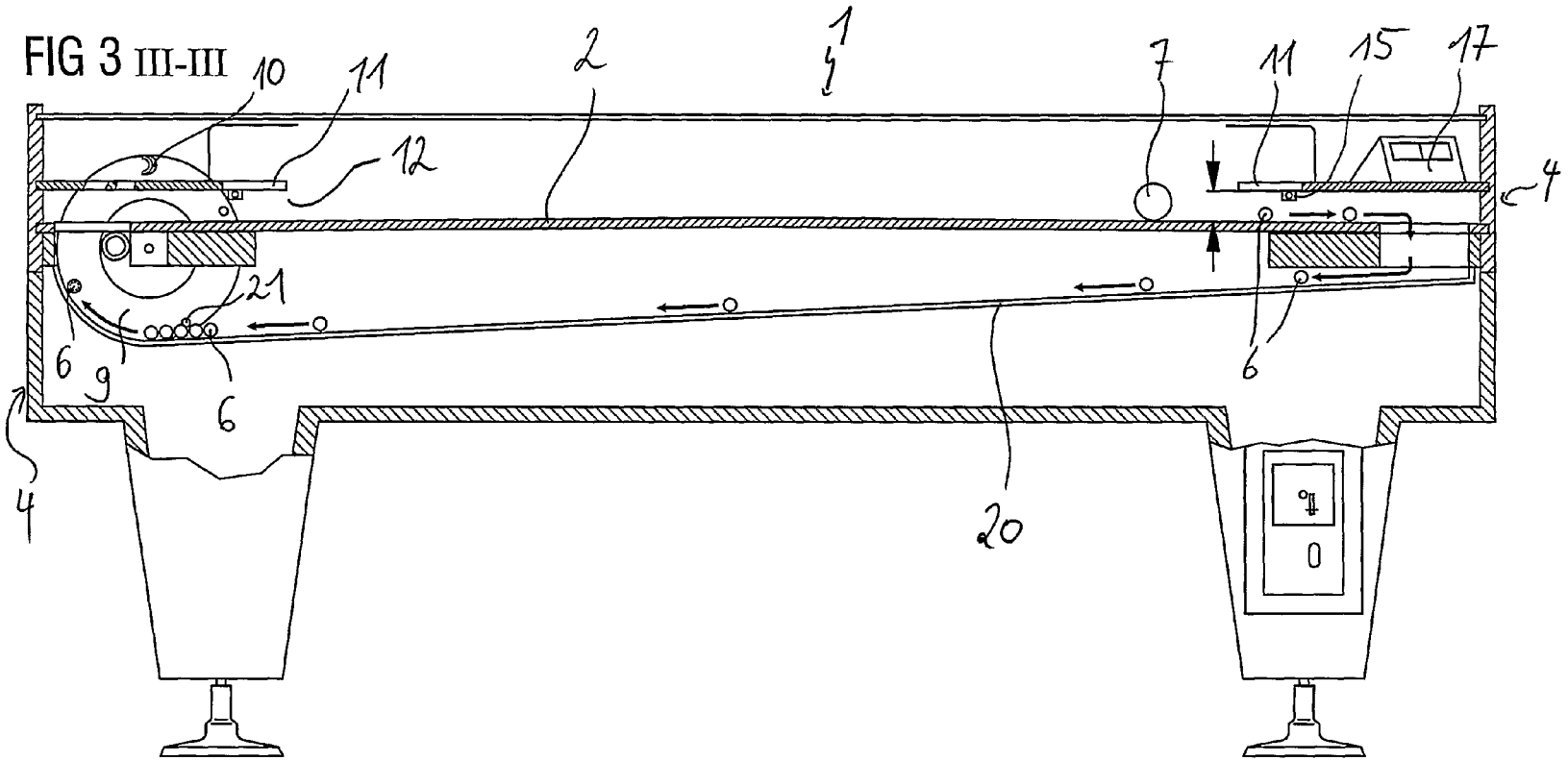
FIG. 3 shows a side view (partially sectioned, III-III) of the table ball game device from FIG. 1.

FIG. 3 shows the table ball game device 1 from FIG. 1 sectioned along the line III-III. The arrangement of the vertical delimitations 11 which permit the balls 6, but not the playing ball 7, to pass through, can readily be seen in this illustration. The balls 6 can enter a region behind the playing field 2 unobstructed by the slots 12 formed by the plastic plates 11, and drop there onto a sloping plane 20 which is downwardly inclined toward the opposite launching device 5. The balls 6—following gravitational force—roll on the sloping plane 20 toward the opposite pickup wheel 9. The balls 6 which are composed of metal are picked up by magnets 21, which are integrated in the pickup wheel 9, transported to the ball magazine 10 and fed into the latter (see the detailed description for FIGS. 8 and 9).

Figure 4:
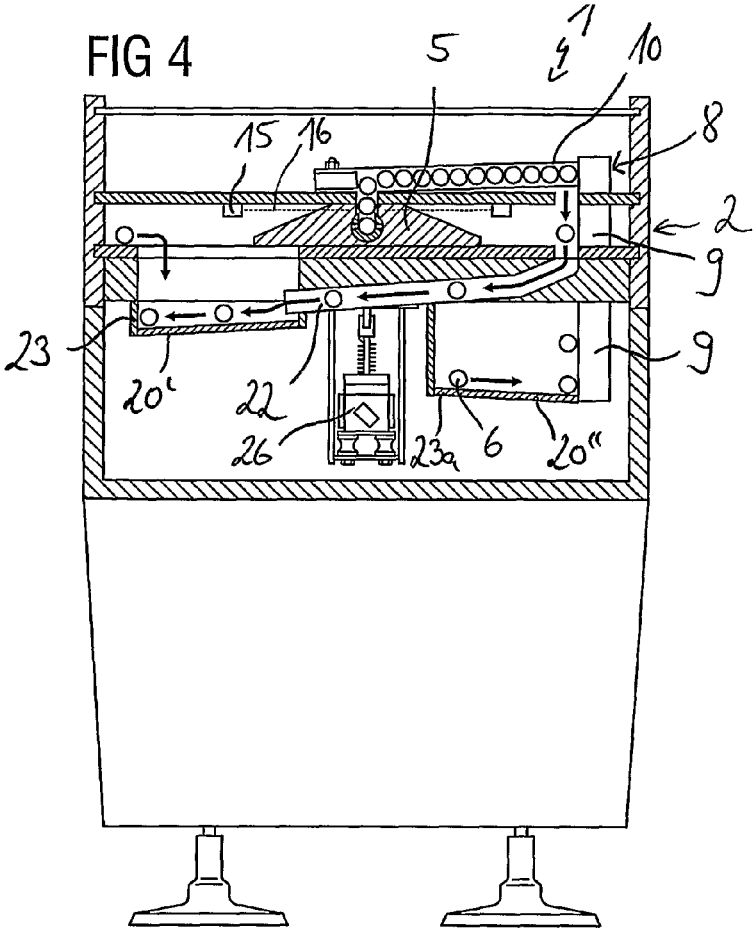
FIG. 4 shows a cross section through the table ball game device from FIG. 1 in the region of a launching device (section IV-IV)

FIG. 4 shows a cross section through the table ball game device 1 from FIG. 1 along the line IV-IV. The circulation of the balls 6 is illustrated particularly clearly in this illustration: balls 6 arriving at the pickup wheel 9 are picked up by the latter by means of the magnets 21 and fed into the ball magazine 10. From the ball magazine 10, the balls are conducted further to the launching device 5 and fed into the latter. The balls are launched by the launching device. If the ball magazine 10 is full—as illustrated in this illustration, excess balls 6 are removed by the pickup wheel 9 and drop into a removal tube 22. The removal tube 22 which is slightly inclined transports the balls onto the sloping plane 20' of the removal channel 23. The sloping plane 20' runs in a slightly downwardly inclined manner from the plane to the opposite supply device (not illustrated here). As a result, the balls 6 roll on the sloping plane 20' of the removal channel 23 to the opposite supply device, in particular the pickup wheel. They are picked up there by the pickup wheel and in turn supplied to the opposite launching device. If the opposite ball magazine is full, excess balls drop onto the sloping plane 20" of the removal channel 23*a* and roll up to the pickup wheel 9 by which they are in turn picked up and transported to the launching device 5. In the region of the pickup wheel 9, the removal channel 23*a* is inclined toward the latter so that the balls can roll onto the pickup wheel 9. The removal of excess balls 6 ensures that the balls 6 are always distributed relatively identically to the individual launching devices and that none of the players experiences a shortfall of balls. Balls which enter through the slots into the region behind the actual playing field also roll by means of sloping planes onto the respective removal channels or pass directly into the region of the pickup wheel arranged in this region.

Figure 5:
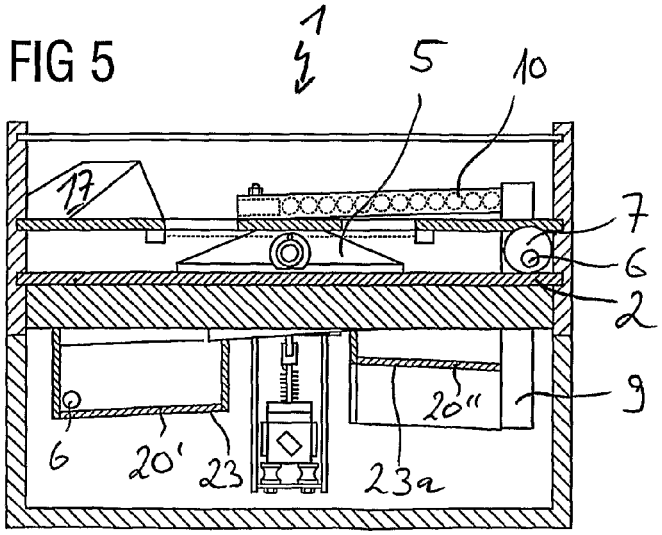
FIG. 5 shows a cross section through the table ball game device from FIG. 1 (section V-V)

FIG. 5 shows a cross section along the line V-V. It can readily be seen in this illustration that the ball can be hit by balls 6 even in the corners of the playing field.

Figure 6:
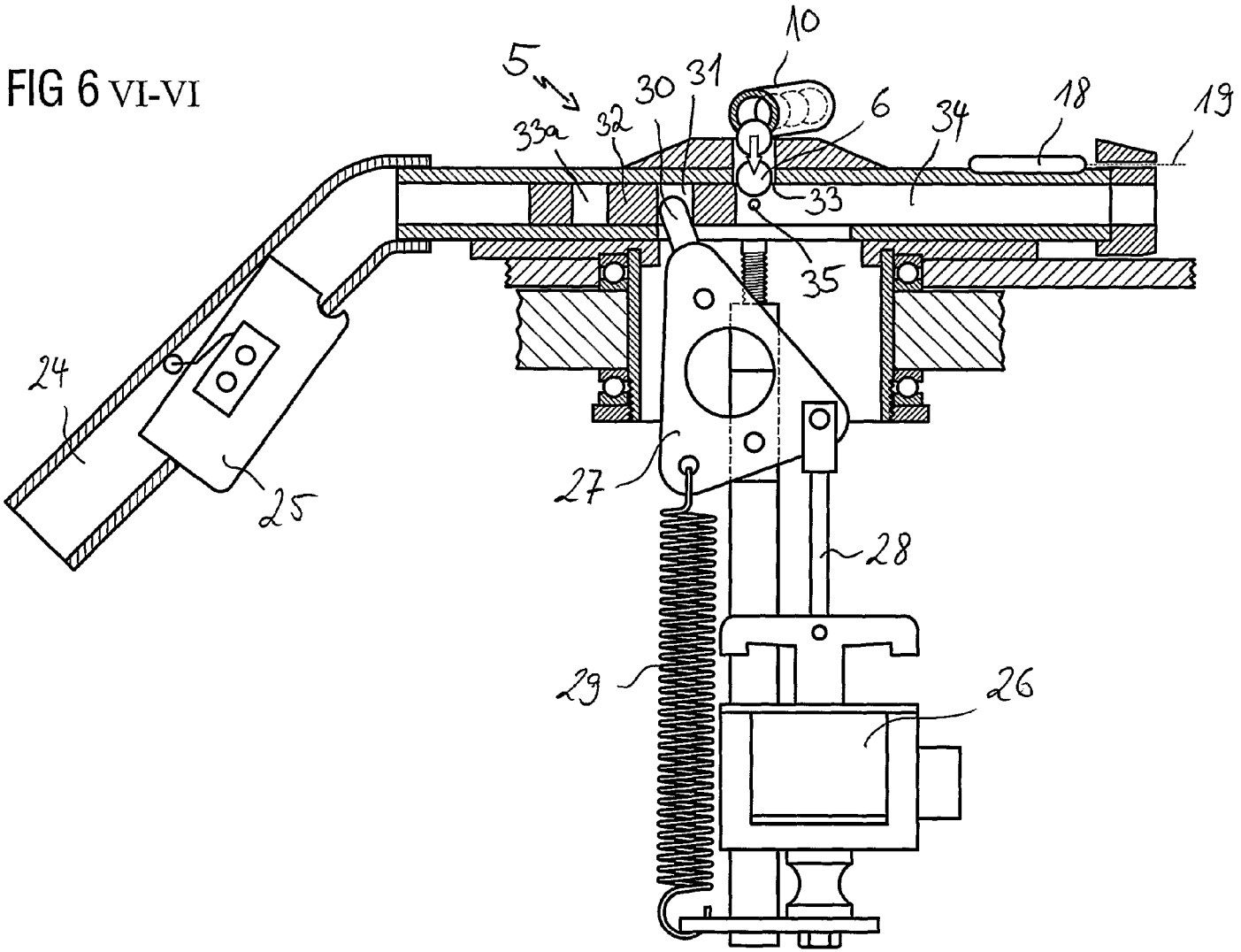
FIG. 6 shows a longitudinal section through a launching device of the table ball game device from FIG. 1 (section VI-VI) before a ball is launched.

FIG. 6 shows a longitudinal section through a launching device 5 along the line VI-VI. The launching device 5 has a pistol-shaped design with a handle 24 in which a trigger 25 for triggering the shooting mechanism is integrated, wherein a solenoid 26 which is in electric contact with the trigger 25 is activated when the shooting mechanism is triggered. The solenoid is connected to a lever 27 which is arranged pivotably. The lever 27 is in the form of an equilateral triangle, wherein a pin 28 which is connected to the solenoid acts on a corner of the lever 27 and a spring 29 acts on the adjacent corner of the lever 27. The lever 27 has a pin 30 which protrudes out of the third corner of the lever and engages in a cutout 31 in the launching bolt 32. FIG. 6 shows the launching device 5 before a shot is triggered, i.e. in the inoperative position. In this phase, the lever 27 is pivoted by the force of the spring 29 in such a manner that the launching bolt 32 opens up a cutout 33 through which an arriving ball 6 can enter the launching passage 34. Directly below the cutout 33, a magnet 35 which keeps the metal ball 6 in position is arranged in the launching passage 34. The launching bolt 32 has a further cutout 33*a*, as a result of which, when one side is worn, the launching bolt 32 can be turned through 180° such that the second end side of the launching bolt can also be stressed.

Figure 7:
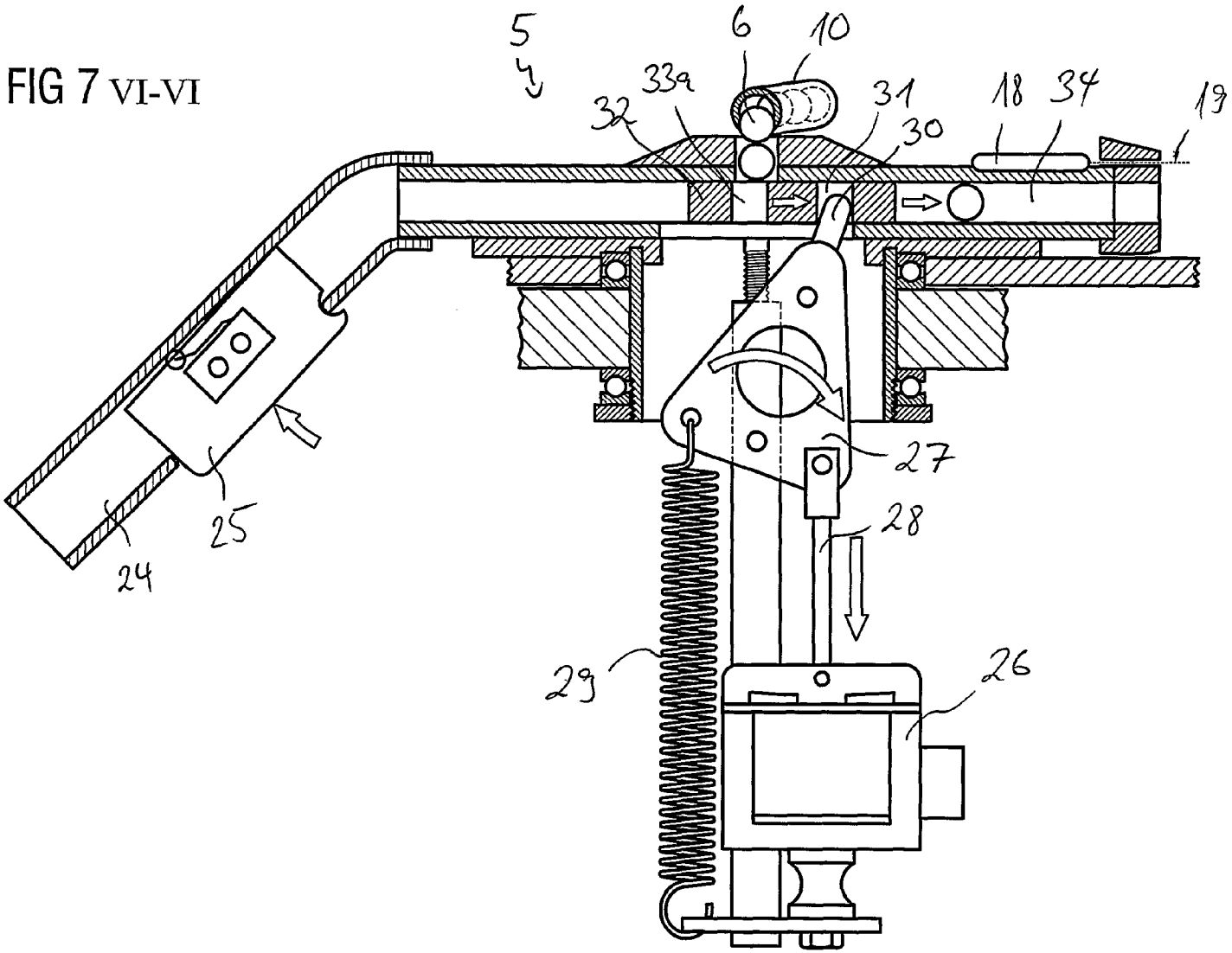
FIG. 7 shows a longitudinal section through a launching deice of the table ball game device from FIG. 1 (section VII-VII) after a ball is launched.

In FIG. 7, the launching device from FIG. 6 can be seen after the trigger 25 has activated the solenoid 26. By activation of the solenoid 26, the latter pulls the pin 28 abruptly downward, as a result of which the lever 27 is pivoted to the right counter to the spring force of the spring 29. As a result, the ball in the launching passage 34 is shot out of the launching passage 34 onto the playing field. In this position, no further ball can pass into the launching passage 34. After the ball is launched, the solenoid 26 is deactivated, as a result of which the lever 27 is returned back into the inoperative position (see FIG. 6) by the spring force of the spring 29.

The laser 18 for aiming at the balls 6 can furthermore be seen in FIGS. 6 and 7.

Figure 8:
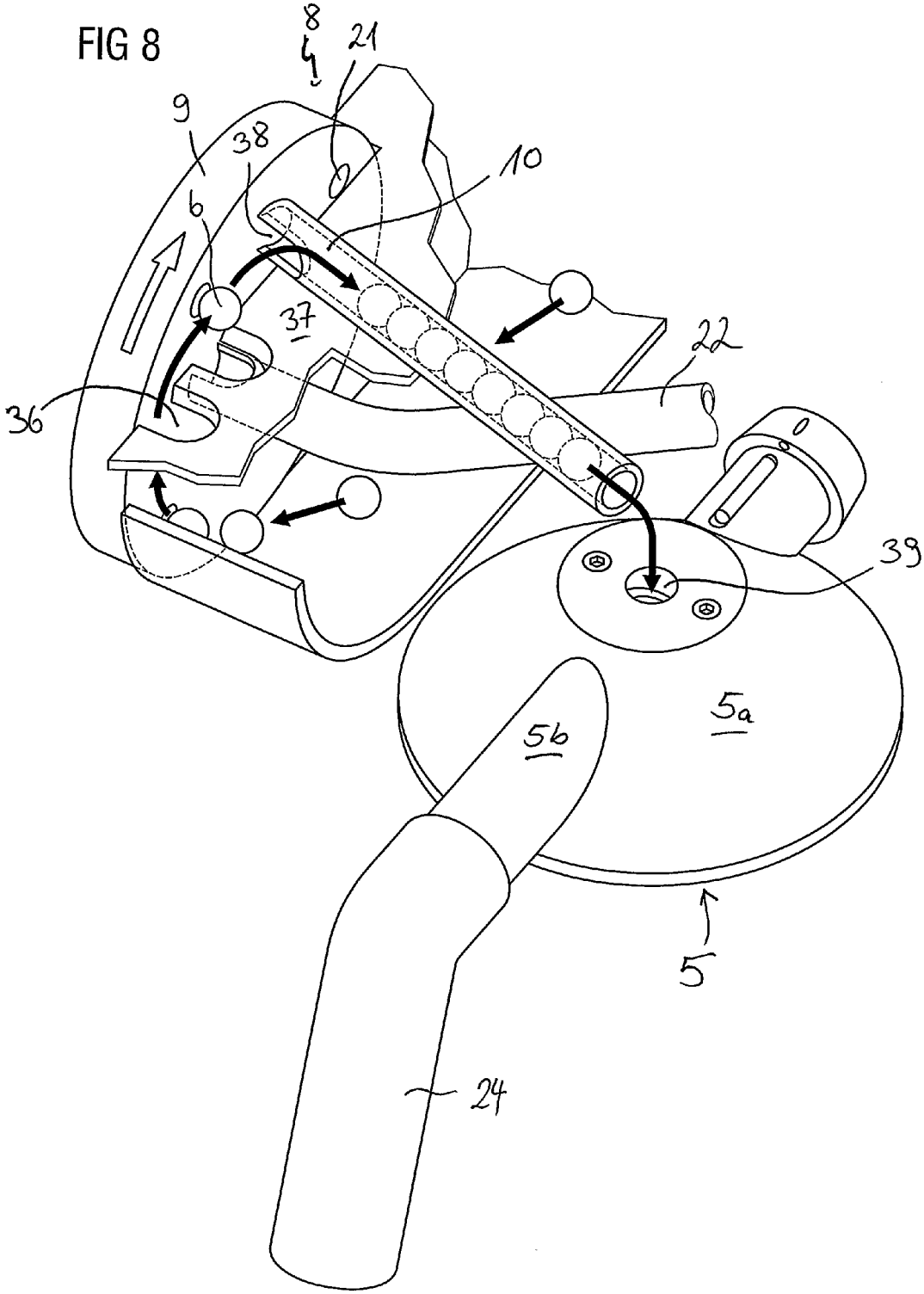
FIG. 8 shows a perspective illustration of the supply device of the table ball game device from FIG. 1 in combination with the launching device and the removal device.

FIG. 8 shows a perspective illustration of the supply device 8 with the pickup wheel 9 and the ball magazine 10. Double-pole magnets 21 are integrated in the pickup wheel 9. The double polarity prevents magnetic charging of the balls 6. The magnets 21 each hold a ball. By rotation of the pickup wheel 9 in the clockwise direction, the balls 6 are first of all moved through a cutout 36 in a holding plate 37, which is arranged in the region of the pickup wheel 9, and finally enter through a cutout 38 in the ball magazine 10 and are mechanically removed there. In the present illustration, the ball magazine 10 is not yet fully loaded, and therefore balls still pass into the ball magazine 10. From the ball magazine 10, the balls successively enter the launching device 5 through a cutout 39 in the launching device 5. The balls 6 can enter the launching device 5 only individually. The launching device 5 comprises a rotary disk 5*a* and a launching barrel 5*b* which passes through the rotary disk 5*a* and from which the balls are launched. The entire launching device (as already described above) is arranged pivotably on the playing table.

Figure 9:
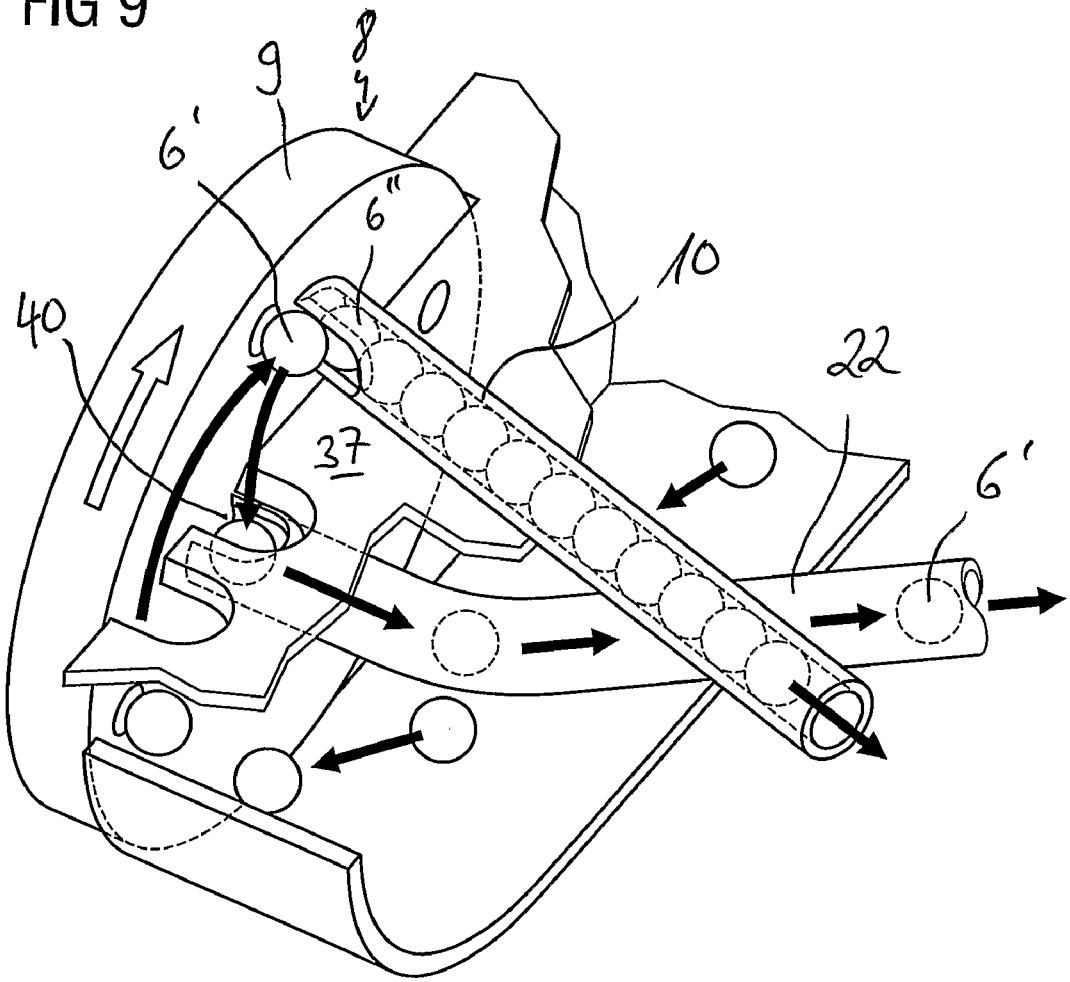
FIG. 9 shows a perspective illustration of the supply device of the table ball game device from FIG. 1 in combination with the launching device and the removal device.

FIG. 9 shows the supply device 8 from FIG. 8 at a stage in which the ball magazine 10 is full and no further balls can be picked up. If a ball 6' now arrives at the full ball magazine 5, the ball is removed mechanically from the final ball 6" in the ball magazine by the pickup wheel 9, drops through a cutout in the holding plate 37 and finally enters the removal tube 22 in which—following gravitational force—it rolls in the direction of the sloping plane (not illustrated here). The removed ball 6' finally rolls up to the opposite supply device.

Figure 10:
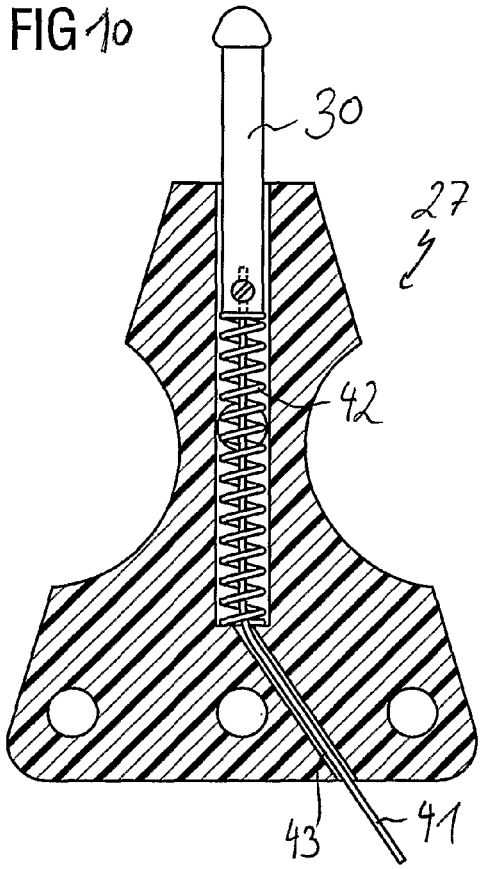
FIG. 10 shows an actuating lever of a launching device according to the invention.
Figure 11:
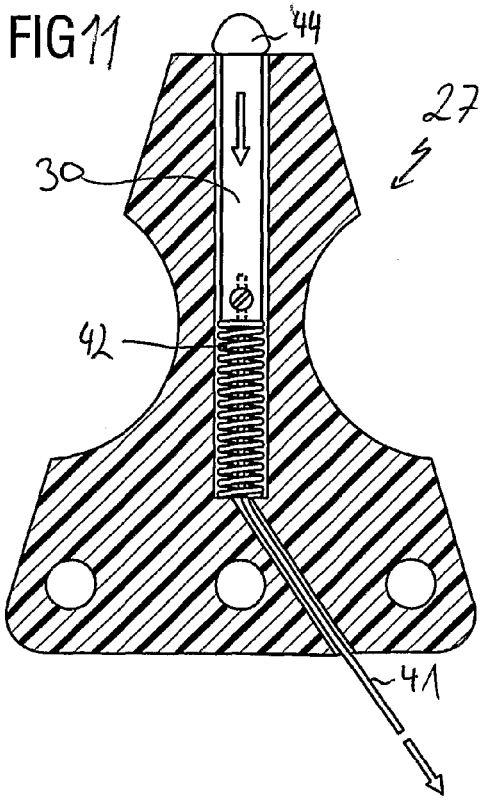
FIG. 11 shows the actuating lever from FIG. 10 during the exchange of a shooting pin.

FIG. 10 shows a longitudinal section through the lever 27. The pin 30 of the lever 27 is connected on its lower side to a cord 41. Furthermore, a spring 42 is located in the interior of the lever 27. The cord 41 first of all runs through the coils of the spring 42 and subsequently through a passage 43 in the lever 27 and finally leads to the outside. If (as illustrated in FIG. 11) the cord is now pulled, the pin 30 is pulled into the interior of the lever until the cap 44 of the pin 30 strikes against the body of the lever 27. In this position, the pin can be pulled out of the cutout in the above-described launching bolt 32, as a result of which the bolt can easily be exchanged. For easier exchangeability, the end sides of the bolt 32 each have a magnet such that the bolt can easily be fetched out of the launching device by a bar magnet.

When the pin 30 becomes worn, it can also be easily exchanged by the pin 30 being pulled upward out of the body of the lever 27.

FIG. 12 shows a further embodiment 100 of a table ball game device according to the invention, which embodiment is suitable for playing by a single player. This device 100 has the same launching device 5 and the same supply device 8 as the above-described device 1 on one narrow side 4*a*. On the opposite narrow side 4*b*, said device 100 has an automatic ball shooting device 101. Said ball shooting device comprises a shaft 102 which is mounted rotatably about the longitudinal axis thereof and, for its part, is equipped with shooting bars 103 arranged in parallel. The distances between the individual shooting bars are smaller than the diameter of the playing ball 7. The shaft 102 is fixed at one end on a rotary disk 104 which, in turn, is driven by an electric motor 106 via a driving belt 105 and sharply rotates the shaft 102.

If a playing ball 7 then comes into contact with the rotating shooting bars 103 of the rotating shaft 102, the ball 7 is driven by the shooting bars striking against it away from the ball shooting device in the direction of the opposite narrow side. The task of the (single) player is to keep the ball 7 away from the goal 14, by actuating the launching device 5 and shooting balls 6 at the ball 7, and to prevent the ball shooting device 101 from scoring goals. By shooting the ball 7 with balls 6, the ball 7 is driven back to the ball shooting device 101. The greater the speed at which the ball strikes against the rotating shooting bars 103, the greater the speed at which the ball is shot again in the other direction (toward the player's goal). Furthermore, the direction in which the ball is shot by the ball shooting device 101 is always dependent on how the ball 7 strikes against the shooting bars 103 (for example at what angle). Therefore, the direction of the shot-back ball cannot be foreseen by the player, which, of course, increases the tension of the game.

In order to prevent the ball 7 from being hurled upward by the shooting bars, cushioning bars 107 are arranged in the region of the ball shooting device 101. The distances between the individual cushioning bars 107 are smaller than the diameter of the playing ball 7. The cushioning bars 107 are arranged in such a manner that the shooting bars 103 are offset with respect thereto and can thus rotate unhindered between the cushioning bars 107. The cushioning bars 107 are fixed to the frame 108.

FIG. 13 shows the table ball game device 100 from FIG. 12 sectioned along the line VII-VII. The ball 7 can roll under the fastening board 109 and, upon contact with the rotating shooting bars 103, is driven in the direction of the launching device 5.

Launched balls drop in the region of the ball shooting device onto a sloping plane (cannot be seen here) which lies under the playing field and on which said balls roll toward the opposite supply device 8 and are fed again into the launching device 5.

One of a number of blocking pins 110 arranged next to one another can also be seen in this illustration. Said blocking pins serve to keep the playing ball 7 at a certain distance from the narrow side 4*b* in order to prevent the rotating shooting bars 103 from striking the ball 7 and the ball shooting device 101 thus being blocked.

FIG. 14 shows the table ball game device 100 from FIGS. 12 and 13 with the cushioning bars 107 having been removed. The blocking pins 110 which are located directly thereunder can now be seen. The distance between the individual blocking pins is smaller than the diameter of the ball 7. As a result, the ball 7 cannot roll between two blocking pins 110 and is always blocked. The shooting bars 103 rotate in each case between two blocking pins 110.

The invention claimed is:

1. A table ball game device with a playing table, the device comprising:

a playing field defined by opposing playing field edges and opposing narrow sides where the opposing playing field edges are perpendicular to the narrow sides;

a first launching device for launching magnetizable balls at a playing ball located in the playing field, the device pivotally coupled to the table in the region of at least one narrow side;

a first supply device assigned to the first launching device wherein the first supply device automatically supplies balls to the first launching device;

a first rotating pickup wheel having magnets disposed thereon for picking up and transporting the magnetizable balls; and a first ball magazine operatively coupled to the first pickup wheel and the first launching device wherein the first pickup wheel feeds balls into the first ball magazine which in turn feeds the balls to the first launching device.

2. The device of claim 1 wherein the first pickup wheel is motor driven.

3. The device of claim 1 wherein the first ball magazine is in the form of an elongated tube.

4. The device of claim 1 wherein the magnets are double-pole permanent magnets and the magnetizable balls are metal.

5. The device of claim 1 further comprising an automatically acting device located in the region of the narrow side opposite to that narrow side which has the first launching device wherein the automatically acting device automatically shoots back any ball arriving at its narrow side.

6. The device of claim 5 wherein the direction of the shot back ball is random and changing.

7. The device of claim 1 further comprising a second launching device pivotally coupled to the table in the region of the other, opposite narrow side; and a second supply device assigned to the second launching device wherein the second supply device automatically supplies balls to the second launching device.

8. The device of claim 7 wherein the second supply device comprises:

a second rotating pickup wheel for picking up and transporting the balls;

a second ball magazine operatively coupled to the second pickup wheel and the second launching device wherein the second pickup wheel feeds balls into the second ball magazine which in turn feeds the balls to the second launching device;

wherein a respective ball magazine can only receive a limited number of balls and excess balls which can no longer be received by the respective ball magazine are removed by the respective pickup wheel and conducted by a transport passage to a supply channel which is downwardly inclined toward the respective opposite narrow side and transported to the respective opposite supply device.

9. The device of claim 1 further comprising vertical delimitations provided in front of the first launching device wherein the vertical delimitation extend from one playing field edge to the opposing playing field edge wherein the location of the vertical delimitation above the playing field is such that balls launched by the first and second launching devices may pass through but not the playing ball.

10. The device of claim 9 wherein goals are defined by the vertical delimitation in front of the first launching device into which the playing ball is to be driven in by the balls launched by the first launching device.

11. The device of claim 10 further comprising light barriers extending across the goal and a display wherein, when a playing ball crosses the light barrier, a score is indicated on the display.

12. The device of claim 1 wherein the playing field slopes downward from a center point of the playing field to each of the narrow sides.

13. The device of claim 1 wherein the first launching device includes a solenoid to operate the device.

14. The device of claim 1 further comprising a laser located on the first launching device wherein the laser points in a direction in which a ball will be launched from the first launching device.

15. The table ball game device of claim 1, wherein the launching device has a pistol-shaped design with a handle in which a trigger for triggering the shooting mechanism is integrated, a solenoid being activated when the shooting mechanism is triggered, the solenoid setting a lever into motion, said lever, in turn, setting a shooting pin into motion, the shooting pin setting a ball which is to be launched into motion.

16. The table ball game device of claim 15, wherein, when the shooting mechanism is triggered, the lever is moved counter to the force of a spring by means of which the lever is returned again into its original position after the shot is triggered.

* * * * *